US009389530B2

(12) United States Patent
Yamada et al.

(10) Patent No.: US 9,389,530 B2
(45) **Date of Patent: *Jul. 12, 2016**

(54) LIQUID DEVELOPER

(71) Applicant: KONICA MINOLTA, INC., Chiyoda-ku (JP)

(72) Inventors: Chiaki Yamada, Ibaraki (JP); Mikihiko Sukeno, Ashiya (JP); Yuya Iwagoe, Kyoto (JP); Masaaki Oka, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/561,361

(22) Filed: Dec. 5, 2014

(65) Prior Publication Data

US 2015/0160577 A1 Jun. 11, 2015

(30) Foreign Application Priority Data

Dec. 6, 2013 (JP) ..... 2013-253064

(51) Int. Cl.
*G03G 9/00* (2006.01)
*G03G 9/13* (2006.01)
*G03G 9/135* (2006.01)

(52) U.S. Cl.
CPC ..... *G03G 9/132* (2013.01); *G03G 9/131* (2013.01); *G03G 9/133* (2013.01); *G03G 9/135* (2013.01)

(58) Field of Classification Search
CPC ..... G03G 9/131; G03G 9/133
USPC ..... 430/114
See application file for complete search history.

(56) References Cited

U.S. PATENT DOCUMENTS

2012/0315060 A1 12/2012 Sugiyama et al.
2013/0084092 A1 4/2013 Ooyanagi

FOREIGN PATENT DOCUMENTS

JP 2012-107229 A 6/2012
JP 2012-118496 A 6/2012
JP 2013-076890 A 4/2013

*Primary Examiner* — Mark A Chapman
(74) *Attorney, Agent, or Firm* — Buchanan Ingersoll & Rooney PC

(57) ABSTRACT

A liquid developer includes an insulating liquid and toner particles which are dispersed in the insulating liquid and contain a resin and a coloring agent. The resin contains a first resin which is a crystalline urethane-modified polyester resin resulting from increase in chain length of a component derived from a polyester resin by a compound containing an isocyanate group. The toner particles have a peak in a DSC curve in temperature increase at 55° C. or higher, have a peak in the DSC curve in temperature decrease at 30° C. or higher, and have a storage elastic modulus at 80° C., not lower than $1\times10^5$ Pa and not higher than $1\times10^7$ Pa.

4 Claims, 4 Drawing Sheets

LIQUID DEVELOPER

This application is based on Japanese Patent Application No. 2013-253064 filed with the Japan Patent Office on Dec. 6, 2013, the entire content of which is hereby incorporated by reference.

BACKGROUND OF THE INVENTION

1. Field of the Invention

The present invention relates to a liquid developer containing an insulating liquid and toner particles which are dispersed in the insulating liquid and contain a resin and a coloring agent.

2. Description of the Related Art

In recent years, in order to reduce energy consumed during fixation, development of a liquid developer excellent in low-temperature fixability has been promoted. For example, according to Japanese Laid-Open Patent Publication No. 2012-107229, a liquid developer excellent in low-temperature fixability can be provided when particle size distribution of toner particles contained in the liquid developer is narrow and a shape of the toner particles is uniform.

When a liquid developer excellent in low-temperature fixability is employed, however, molten toner tends to adhere to a fixation roller during fixation. This is called high-temperature offset, in which a liquid developer may offset to such a recording medium as paper when a fixation roller is contaminated. Therefore, in development of a liquid developer excellent in low-temperature fixability, occurrence of high-temperature offset is preferably suppressed while moderate gloss and fixation strength are ensured.

When a liquid developer excellent in low-temperature fixability is employed and when a printed matter obtained by fixing toner particles to a recording medium is stored in a high-temperature condition or a pressurized condition, toner particles tend to be softened and color transfer is likely. This is called document offset. Therefore, in development of a liquid developer excellent in low-temperature fixability, occurrence of document offset is also preferably suppressed while moderate gloss and fixation strength are ensured.

SUMMARY OF THE INVENTION

The present invention was made in view of such aspects, and an object of the present invention is to provide a liquid developer excellent in low-temperature fixability, with which occurrence of high-temperature offset and document offset is prevented while moderate gloss and fixation strength are ensured.

A liquid developer includes an insulating liquid and toner particles which are dispersed in the insulating liquid and contain a resin and a coloring agent. The resin contains a crystalline urethane-modified polyester resin resulting from increase in chain length of a component derived from a polyester resin by a compound containing an isocyanate group. The toner particles have a peak in a differential scanning calorimetry (DSC) curve in temperature increase at 55° C. or higher, have a peak in the DSC curve in temperature decrease at 30° C. or higher, and have a storage elastic modulus at 80° C., not lower than $1\times10^5$ Pa and not higher than $1\times10^7$ Pa.

The "component derived from the polyester resin" means a polyester resin from which one or more atoms have been removed from terminal end(s), and it includes a polyester resin from which one hydrogen atom has been removed from each of opposing terminal ends and a polyester resin from which one hydrogen atom has been removed from one terminal end.

A "chain length" means bonding between a component derived from a polyester resin and a compound containing an isocyanate group such that the urethane-modified polyester resin is linear.

When the DSC curve in temperature increase of toner particles has two or more peaks, a peak located on a lowest temperature side of the two or more peaks is preferably at 55° C. or higher. When the DSC curve in temperature decrease of toner particles has two or more peaks, a peak located on a lowest temperature side of the two or more peaks is preferably at 30° C. or higher.

Preferably, x and y satisfy Equations (1) to (3):

$$y\leq-0.0002x+11 \quad (1);$$

$$10000\leq x\leq50000 \quad (2); \text{ and}$$

$$1\leq y\leq5.5 \quad (3),$$

where x represents a number average molecular weight of a first resin and y represents a concentration of a urethane group in the first resin. A concentration of a urethane group in the first resin can be found as a value defined as (a mass of a urethane group contained in a urethane-modified polyester resin)/(a mass of the urethane-modified polyester resin)×100.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

<Liquid Developer>

Figure 1A:
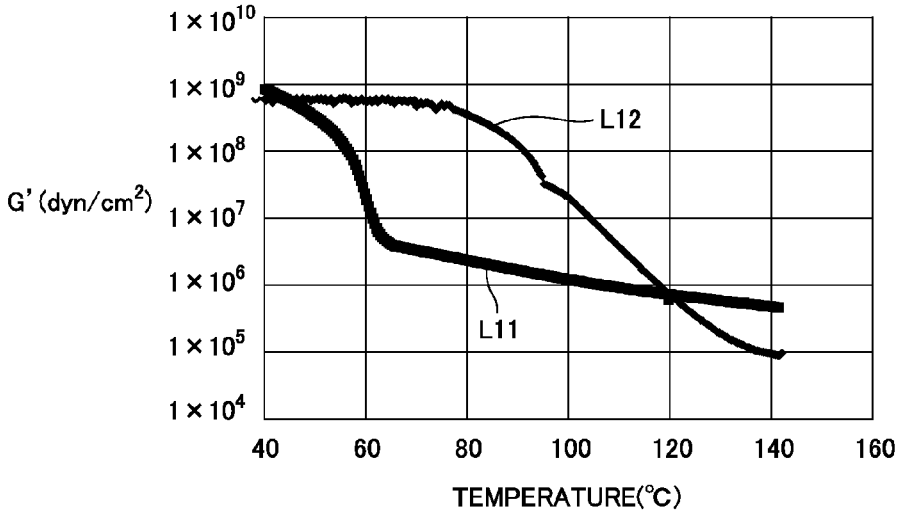
FIG. 1A is a graph showing a result of measurement of temperature dependency of a storage elastic modulus G and FIG. 1B is a graph showing a result of finding temperature dependency of $|\Delta \log(G')/\Delta T|$ from FIG. 1A.

A liquid developer according to the present embodiment is useful as a liquid developer for electrophotography used in an image formation apparatus of an electrophotography type (which will be described later) such as a copying machine, a printer, a digital printer, or a simple printer, a paint, a liquid developer for electrostatic recording, an oil-based ink for ink jet printer, or an ink for electronic paper. The liquid developer according to the present embodiment includes an insulating liquid and toner particles which are dispersed in the insulating liquid and contain a resin and a coloring agent. Preferably, the liquid developer according to the present embodiment contains 10 to 50 mass % of toner particles and 50 to 90 mass % of the insulating liquid. The liquid developer according to the present embodiment may contain any component other than the toner particles and the insulating liquid. Preferably, any component other than the toner particles and the insulating liquid may be, for example, a thickener or a dispersant.

<Toner Particles>

Toner particles in the present embodiment contain a resin and a coloring agent dispersed in the resin. A content of each of the resin and the coloring agent in the toner particles is preferably determined such that desired image density is obtained when an amount of adhesion of toner particles to such a recording medium as paper is within a prescribed range. The toner particles according to the present embodiment may contain any component other than the resin and the coloring agent. Any component other than the resin and the coloring agent is, preferably, for example, a dispersant for a pigment, a wax, or a charge control agent.

A resin contained in toner particles in the present embodiment contains a first resin which is a crystalline urethane-modified polyester resin. "Crystallinity" means that a ratio between a softening start temperature of a resin (hereinafter abbreviated as "Tm") and a maximum peak temperature (hereinafter abbreviated as "Ta") of heat of fusion of the resin (Tm/Ta) is not lower than 0.8 and not higher than 1.55 and that a result of change in amount of heat obtained in DSC does not show stepwise change in amount of heat absorption but has a clear heat absorption peak. A ratio between Tm and Ta (Tm/Ta) being higher than 1.55 can mean that such a resin is not excellent in crystallinity and also that such a resin has non-crystallinity.

A flow tester (capillary rheometer) (such as CFT-500D manufactured by Shimadzu Corporation) can be used to measure Tm. Specifically, while 1 g of a sample is heated at a temperature increase rate of 6° C./min., a plunger applies load of 1.96 MPa to the sample to thereby extrude the sample from a nozzle having a diameter of 1 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tm.

A differential scanning calorimeter (for example, a trade name "DSC210" manufactured by Seiko Instruments, Inc.) can be used to measure Ta. Specifically, a sample is molten at 130° C., thereafter a temperature is lowered from 130° C. to 70° C. at a rate of 1.0° C./min., and thereafter a temperature is lowered from 70° C. to 10° C. at a rate of 0.5° C./min. Thereafter, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range from 20 to 100° C. is defined as Ta'. When there are a plurality of heat absorption peaks, a temperature of a peak largest in amount of heat absorption is defined as Ta'. After the sample was stored for 6 hours at (Ta'-10)° C., it is in turn stored for 6 hours at (Ta'-15)° C.

After pre-treatment of the sample ends, with the DSC method, the sample subjected to the pre-treatment above is cooled to 0° C. at a temperature lowering rate of 10° C./min., and then a temperature is raised at a temperature increase rate of 20° C./min. Based on change in heat absorption and generation thus measured, relation between an "amount of heat absorption and generation" and a "temperature" is plotted in a graph. A temperature at which an amount of heat absorption attains to a maximum value is defined as a maximum peak temperature (Ta) of heat of fusion.

Whether or not a resin has excellent crystallinity can be known also by examining temperature dependency of a storage elastic modulus G'. Temperature dependency of storage elastic modulus G' can be measured under conditions shown below, with a viscoelasticity measurement apparatus (ARES) manufactured by TA Instruments, Japan.

Jig used for measurement: 8-mm parallel plate

Frequency: 1 Hz

Distortion factor: 5%

Measurement start temperature: 40° C.

Rate of temperature increase: 5° C./min.

Figure 1B:
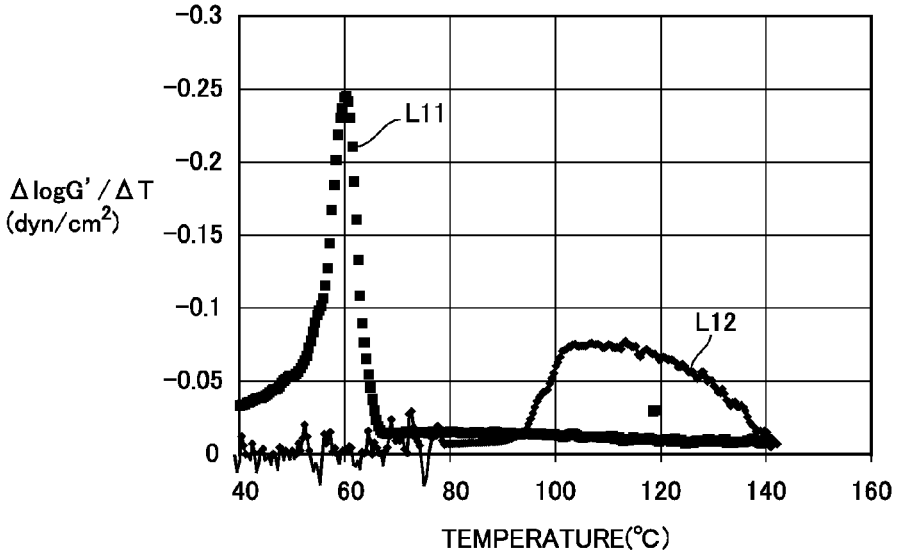

FIG. 1A is a graph showing a result of measurement of temperature dependency of storage elastic modulus G' and FIG. 1B is a graph showing a result of finding temperature dependency of $|\Delta \log(G')/\Delta T|$ from FIG. 1A. In FIGS. 1A and 1B, L11 represents a result of a crystalline polyester resin and L12 represents a result of a non-crystalline polyester resin.

In connection with the crystalline polyester resin, a peak derived from softening of the crystalline resin was clearly observed in FIG. 1B and a softening start temperature of the toner particles could be found as 56° C. A storage elastic modulus at 80° C. was approximately $2\times10^6$ (dyn/cm$^2$). On the other hand, in connection with the non-crystalline polyester resin, in FIG. 1B, a peak derived from softening of the non-crystalline resin could not be observed. A storage elastic modulus at 80° C. was approximately $1\times10^8$ (dyn/cm$^2$) or more, and it is considered that melting of toner particles has not yet started at 80° C. It is noted that 1 Pa=10 dyn/cm$^2$.

Thus, the crystalline polyester resin clearly has a peak derived from softening thereof and a peak temperature is relatively low. A storage elastic modulus of the crystalline polyester resin at 80° C. is within a desired range. Therefore, when toner particles contain the first resin, a liquid developer which is capable of preventing occurrence of high-temperature offset and is excellent in low-temperature fixability and free from lowering in fixability can be provided. Specifically, by increasing a chain length of a polyester resin by a compound containing an isocyanate group, elasticity of a resin can be retained also on a high temperature side, and hence occurrence of high-temperature offset can be prevented. Such an effect can effectively be obtained when the resin contains the first resin by 80 mass % or more.

A peak temperature in a DSC curve in temperature increase of the toner particles is 55° C. or higher and a peak temperature in the DSC curve in temperature decrease of the toner particles is 30° C. or higher. The present inventors have confirmed that when images were formed with the liquid developer according to the present embodiment, no document offset occurred even after surfaces having images formed were layered on each other with load of 80 g/cm$^2$ being applied thereto and two recording media having the images formed were stored for 10 days in an environment at 55° C. The reason therefor may be as follows.

When a peak temperature in the DSC curve in temperature increase of the toner particles is 55° C. or higher, the toner particles can be prevented from being molten at a temperature lower than 55° C. Therefore, even though surfaces having images formed are layered on each other and two recording media having the images formed are stored in an environment at a high temperature, the toner particles forming the image can be prevented from being molten. Thus, occurrence of document offset can be prevented. A peak temperature in a DSC curve in temperature increase of the toner particles is preferably not lower than 55° C. and not higher than 65° C. and more preferably not lower than 55° C. and not higher than 60° C.

When a peak temperature in the DSC curve in temperature decrease of the toner particles is 30° C. or higher, a peak temperature in the DSC curve in temperature decrease of the toner particles can be lower than a softening start temperature of the toner particles in some cases. Thus, when toner particles are fixed onto a recording medium and thereafter a temperature of the recording medium is lowered to room temperature, sufficient time for recrystallization is given to the first resin. Therefore, an image excellent in degree of gloss can be obtained. An image excellent in damage resistance can thus be provided and hence an image less prone to document offset can be provided. A peak temperature in the DSC curve in temperature decrease of the toner particles is preferably not lower than 30° C. and not higher than 50° C. and more preferably not lower than 30° C. and not higher than 45° C.

A peak temperature in the DSC curve in temperature increase of the toner particles and a peak temperature in the DSC curve in temperature decrease of the toner particles can be found in accordance with a method shown below.

Initially, toner particles are separated from a liquid developer. Specifically, the liquid developer is centrifuged to remove a supernatant. After a remaining solid content is washed with an organic solvent (such as hexane), the solid content is dried at room temperature with the use of a vacuum dryer. A series of such procedures may be performed two or more times.

In determining a peak temperature in the DSC curve in temperature increase of the toner particles, DSC measurement is conducted under conditions shown below, with the use of the toner particles separated from the liquid developer. A result of DSC measurement is shown with a curve (a DSC curve) in which the ordinate represents a heat flow and the abscissa represents a temperature or time. Exothermic reaction appears as a positive peak in the DSC curve and endothermic reaction appears as a negative peak in the DSC curve. A peak temperature of the peak which appears on the lowest temperature side of negative peaks which appear in the DSC curve is found. That temperature represents a peak temperature in the DSC curve in temperature increase of the toner particles.

Differential scanning calorimeter: Trade name "DSC6200" manufactured by Hitachi High-Technologies Corporation Mass of sample (toner particles): 10 mg Reference sample: a alumina Mass of reference sample: 10 mg Rate of temperature increase: 10° C./min.

Range of measurement temperature: −10 to 200° C.

In measuring a peak temperature in the DSC curve in temperature decrease of the toner particles, DSC measurement is conducted in accordance with the method of measuring a peak temperature in the DSC curve in temperature increase of the toner particles except that the rate of temperature increase 10° C./min. is changed to −10° C./min. (a rate of temperature decrease 10° C./min.). Then, a peak temperature of the peak which appears on the lowest temperature side of positive peaks which appear in the DSC curve is found. That temperature represents a peak temperature in the DSC curve in temperature decrease of the toner particles.

A storage elastic modulus of the toner particles at 80° C. is not lower than $1\times10^5$ Pa and not higher than $1\times10^7$ Pa. When the storage elastic modulus of the toner particles at 80° C. is not lower than $1\times10^5$ Pa, elasticity of the resin (for example, the first resin) contained in the toner particles can be ensured and hence occurrence of high-temperature offset can be prevented. When the storage elastic modulus of the toner particles at 80° C. is not higher than $1\times10^7$ Pa, the toner particles are molten at the time of fixation and hence fixability of the toner particles can be ensured. A method of measuring a storage elastic modulus of the toner particles at 80° C. is as described above.

As described above, the toner particles in the present embodiment contain the first resin, have a peak temperature in the DSC curve in temperature increase at 55° C. or higher, have a peak temperature in the DSC curve in temperature decrease at 30° C. or higher, and have a storage elastic modulus at 80° C., not lower than $1\times10^5$ Pa and not higher than $1\times10^7$ Pa. Thus, a liquid developer which has excellent low-temperature fixability and ensured moderate gloss and fixation strength and is capable of preventing occurrence of high-temperature offset and document offset can be provided. Such toner particles can be obtained by satisfying, for example, Equations (1) to (3) below:

$$y \leq -0.0002x + 11 \quad (1);$$

$$10000 \leq x \leq 50000 \quad (2); \text{ and}$$

$$1 \leq y \leq 5.5 \quad (3),$$

where x represents a number average molecular weight of the first resin and y represents a concentration of a urethane group in the first resin.

Figure 2:
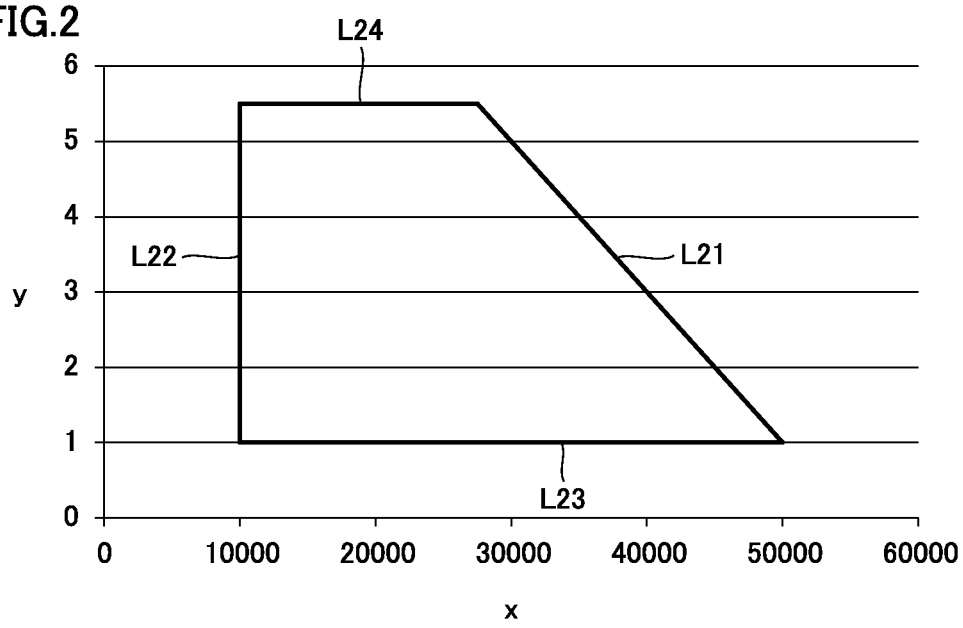
FIG. 2 is a graph showing relation between a number average molecular weight x of a urethane-modified polyester resin and a concentration of a urethane group y in the urethane-modified polyester resin.

FIG. 2 is a graph showing relation between a number average molecular weight x of a urethane-modified polyester resin and a concentration of a urethane group y in the urethane-modified polyester resin. The abscissa in FIG. 2 represents a number average molecular weight x of the urethane-modified polyester resin and the ordinate in FIG. 2 represents a concentration of the urethane group y in the urethane-modified polyester resin. In FIG. 2, L21 represents y=−0.0002x+11, L22 represents x=10000, L23 represents y=1, and L24 represents y=5.5, which is also applicable to FIG. 4 which will be described later.

When the urethane-modified polyester resin has a number average molecular weight x not smaller than 10000, the toner particles have a storage elastic modulus at 80° C., not lower than $1\times10^5$ Pa, and hence occurrence of high-temperature offset can be prevented. When the urethane-modified polyester resin has a number average molecular weight x not greater than 50000, the toner particles have a storage elastic modulus at 80° C., not higher than $1\times10^7$ Pa, and hence fixation strength can be ensured. The urethane-modified polyester resin has a number average molecular weight x preferably not smaller than 10000 and not greater than 30000.

When a concentration of the urethane group y in the urethane-modified polyester resin is not higher than 5.5%, occurrence of document offset can be prevented. For example, even when surfaces having images formed are layered on each other with load of 80 g/cm$^2$ being applied thereto and two recording media having the images formed are stored for 10 days in an environment at 55° C., occurrence of document offset can be prevented. This may be because when a urethane group concentration y in the urethane-modified polyester resin is low, a crystal structure of the urethane-modified polyester resin is robust and a peak temperature in the DSC curve in temperature increase of the toner particles becomes high. Therefore, in order to prevent occurrence of document offset, a lower concentration of the urethane group y in the urethane-modified polyester resin is preferred. When a concentration of the urethane group y in the urethane-modified polyester resin is lower than 1%, however, it is expected to be difficult to maintain elasticity of the urethane-modified polyester resin and occurrence of high-temperature offset may occur. Therefore, a concentration of the urethane group y in the urethane-modified polyester resin is preferably not lower than 1%.

For a reason in terms of manufacturing of a polyester resin before urethane modification, urethane group concentration y in the urethane-modified polyester resin has the upper limit. Namely, if a molecular weight of the polyester resin before urethane modification is made smaller, urethane group concentration y can be raised without change in a molecular weight of the urethane-modified polyester resin. In manufacturing of the polyester resin before urethane modification, however, approximately 1000 is the limit of the molecular weight of the polyester resin before urethane modification. In other words, the upper limit of a concentration of the urethane group y in the urethane-modified polyester resin is 7%. Therefore, it is expected that the urethane-modified polyester resin in the present embodiment can be manufactured without difficulty.

When relation of $y \leq -0.0002x+11$ is satisfied, the peak temperature in the DSC curve in temperature increase of the toner particles can be not lower than 55° C. and hence occurrence of document offset can be prevented. The present inventors have found that when a concentration of a urethane group y in the urethane-modified polyester resin is the same, a melting point of the urethane-modified polyester resin is higher as a number average molecular weight x of the urethane-modified polyester resin is smaller. The reason may be because a shorter molecular chain of the urethane-modified polyester resin leads to a stronger crystal structure of the urethane-modified polyester resin and consequently that crystal structure is less likely to collapse in temperature increase.

A concentration of a urethane group in a crystalline urethane-modified polyester resin can be measured with a gas chromatograph mass spectrometer (GCMS) A concentration of a urethane group in the crystalline urethane-modified polyester resin herein is represented by a value measured with the GCMS under conditions shown below after the crystalline urethane-modified polyester resin is thermally decomposed under conditions shown below. Specifically, a concentration of a urethane group in the crystalline urethane-modified polyester resin is calculated by using a ratio of ion intensity detected from the thermally decomposed urethane-modified polyester resin.

(Conditions for Thermal Decomposition of Crystalline Urethane-Modified Polyester Resin)

Apparatus: PY-2020iD manufactured by Frontier Laboratories Ltd.

Mass of Sample: 0.1 mg

Heating Temperature: 550° C.

Heating Time Period: 0.5 minute (Conditions for Measurement of Concentration of Urethane Group in Crystalline Urethane-Modified Polyester Resin)

Apparatus: GCMS-QP2010 manufactured by Shimadzu Corporation

Column: UltraALLOY-5 manufactured by Frontier Laboratories Ltd. (inner diameter: 0.25 mm, length: 30 m, thickness: 0.25 μm)

Temperature Increase Condition: Temperature Increase Range: 100° C. to 320° C. (held at 320° C.)

Rate of Temperature Increase: 20° C./min.

For example, by adjusting a ratio between an amount of an acid group and an amount of a hydroxyl group which are source materials of the polyester resin or a ratio between an amount of an isocyanate group and an amount of a hydroxyl group, number average molecular weight x of the first resin or urethane group concentration y in the first resin can be adjusted.

<Resin>

The resin in the present embodiment contains the first resin, preferably contains the first resin by not lower than 80 mass %, and more preferably contains the first resin by 80 mass % or more and a second resin by 20 mass % or less. The second resin is a resin different from the first resin and may be composed of one type of resin or two or more types of resins as being mixed. A content of the first resin or the second resin in the resin can be found, for example, based on an infrared absorption spectrum, also on a spectrum obtained from nuclear magnetic resonance, or also on a GCMS <First Resin>

The first resin is a urethane-modified polyester resin. A urethane-modified polyester resin is obtained, for example, by polymerizing polyol (an alcohol component) with polycarboxylic acid (an acid component), acid anhydride of polycarboxylic acid (an acid component), or ester of lower alkyl of polycarboxylic acid (an acid component) to thereby obtain a polycondensed product (a polyester resin) and then increasing a chain length of the polyester resin with di(tri)isocyanate. A known polycondensation catalyst can be used for polymerization reaction. A ratio between polyol and polycarboxylic acid is not particularly limited. A ratio between polyol and polycarboxylic acid should only be set such that an equivalent ratio between a hydroxyl group [OH] and a carboxyl group [COOH] ([OH]/[COOH]) is set preferably to 2/1 to 1/5, more preferably to 1.5/1 to 1/4, and further preferably to 1.3/1 to 1/3.

Since the first resin is manufactured through the polymerization reaction above, a component derived from a crystalline polyester resin contained in the first resin contains a constitutional unit derived from an acid component and a constitutional unit derived from an alcohol component. A ratio of a constitutional unit derived from an aliphatic monomer occupied in the constitutional unit derived form the acid component and the constitutional unit derived from the alcohol component is preferably not lower than 90 mass %, more preferably not lower than 95 mass %, and further preferably 100 mass %. Since the component derived from the polyester resin is thus linear, the first resin has excellent crystallinity. The ratio of the constitutional unit derived from the aliphatic monomer occupied in the constitutional unit derived from the acid component and the constitutional unit derived from the alcohol component may be found based on a spectrum obtained from nuclear magnetic resonance or with a GCMS.

In the present embodiment, polyol preferably has a straight chain alkyl skeleton having a carbon number not smaller than 4 and more preferably it is aliphatic diol. Polycarboxylic acid preferably has a straight chain alkyl skeleton having a carbon number not smaller than 4 and more preferably it is aliphatic dicarboxylic acid. This is also the case with "polycarboxylic acid" in each of acid anhydride of polycarboxylic acid and lower alkyl of polycarboxylic acid. Thus, the first resin will express crystallinity. So long as the first resin expresses crystallinity, the first resin may contain aromatic polyol or aromatic polycarboxylic acid. For example, a ratio of a constitutional unit derived from an aromatic monomer occupied in the constitutional unit derived from the acid component and the constitutional unit derived from the alcohol component may be not higher than 10 mass %.

Aliphatic diol is one type of an aliphatic monomer, it is preferably alkane diol having a carbon number from 4 to 10, and it is more preferably, for example, ethylene glycol, 1,3-propylene glycol, 1,4-butanediol, 1,6-hexanediol, 1,9-nonanediol, or 1,10-decanediol.

Aliphatic dicarboxylic acid is one type of an aliphatic monomer, and it is preferably, for example, alkane dicarboxylic acid having a carbon number from 4 to 20, alkene dicarboxylic acid having a carbon number from 4 to 36, or an ester-forming derivative thereof. Aliphatic dicarboxylic acid is more preferably succinic acid, adipic acid, sebacic acid, maleic acid, fumaric acid, or an ester-forming derivative thereof.

A compound containing an isocyanate group is preferably a compound having a plurality of isocyanate groups in a molecule, and it is more preferably chain aliphatic polyisocyanate or cyclic aliphatic polyisocyanate.

Chain aliphatic polyisocyanate is preferably, for example, ethylene diisocyanate, tetramethylene diisocyanate, hexamethylene diisocyanate (hereinafter abbreviated as "HDI"), dodecamethylene diisocyanate, 1,6,11-undecane triisocyanate, 2,2,4-trimethyl hexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl-2,6-diisocyanatohexanoate, or the like. Two or more of these may be used together.

Cyclic aliphatic polyisocyanate is preferably, for example, isophoron diisocyanate (hereinafter abbreviated as "IPDI"), dicyclohexylmethane-4,4'-diisocyanate (hereinafter also denoted as "hydrogenated MDI"), cyclohexylene diisocyanate, methylcyclohexylene diisocyanate (hereinafter also denoted as "hydrogenated TDI"), bis(2-isocyanatoethyl)-4-cyclohexene-1,2-dicarboxylate, 2,5-norbornane diisocyanate, or 2,6-norbornane diisocyanate. Two or more of these may be used together.

Mn of the first resin can be measured with gel permeation chromatography (GPC) under conditions below, with respect to solubles in tetrahydrofuran (THF). Mn and Mw of a resin other than the polyurethane resin can also be measured under conditions shown below.

Measurement apparatus: Trade name "TALC-8120" manufactured by Tosoh Corporation

Column: Trade name "TSKgel GMHXL" (two) manufactured by Tosoh Corporation and trade name "TSKgel Multipore HXL-M" (one) manufactured by Tosoh Corporation Sample solution: 0.25 mass % of THF solution Amount of injection of sample solution into column: 100 μl Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

A number average molecular weight of a polyurethane resin can be measured with the use of GPC under conditions below.

Measurement apparatus: Trade name "HLC-8220GPC" manufactured by Tosoh Corporation Column: Trade name "Guardcolumn α" (one) and trade name "TSKgel α-M" (one)

Sample solution: 0.125 mass % of dimethylformamide solution

Amount of injection of dimethylformamide solution into column: 100 μl

Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

<Second Resin>

The second resin is preferably, for example, a vinyl resin, a polyester resin, a polyurethane resin, an epoxy resin, a polyamide resin, a polyimide resin, a silicon resin, a phenol resin, a melamine resin, a urea resin, an aniline resin, an ionomer resin, or a polycarbonate resin. The second resin is more preferably a vinyl resin, a polyester resin, a polyurethane resin, or an epoxy resin, and further preferably a vinyl resin. Thus, a median diameter D50 (which will be described later) of toner particles and circularity (which will be described later) of toner particles are readily controlled. The second resin preferably also has crystallinity.

The vinyl resin may be a homopolymer obtained by homopolymerizing a monomer having polymeric double bond or a copolymer obtained by copolymerizing two or more types of monomers having polymeric double bond. A monomer having polymeric double bond is, for example, (1) to (9) below.

(1) Hydrocarbon Having Polymeric Double Bond

Hydrocarbon having polymeric double bond is preferably, for example, aliphatic hydrocarbon having polymeric double bond shown in (1-1) below, aromatic hydrocarbon having polymeric double bond shown in (1-2) below, or the like.

(1-1) Aliphatic Hydrocarbon Having Polymeric Double Bond

Aliphatic hydrocarbon having polymeric double bond is preferably, for example, chain hydrocarbon having polymeric double bond shown in (1-1-1) below, cyclic hydrocarbon having polymeric double bond shown in (1-1-2) below, or the like.

(1-1-1) Chain Hydrocarbon Having Polymeric Double Bond

Chain hydrocarbon having polymeric double bond is preferably, for example, alkene having a carbon number from 2 to 30 (such as ethylene, propylene, butene, isobutylene, pentene, heptene, diisobutylene, octene, dodecene, or octadecene); alkadiene having a carbon number from 4 to 30 (such as butadiene, isoprene, 1,4-pentadiene, 1,5-hexadiene, or 1,7-octadiene); or the like.

(1-1-2) Cyclic Hydrocarbon Having Polymeric Double Bond

Cyclic hydrocarbon having polymeric double bond is preferably, for example, mono- or di-cycloalkene having a carbon number from 6 to 30 (such as cyclohexene, vinyl cyclohexane, or ethylidene bicycloheptane); mono- or di-cycloalkadiene having a carbon number from 5 to 30 (such as cyclopentadiene or dicyclopentadiene); or the like.

(1-2) Aromatic Hydrocarbon Having Polymeric Double Bond

Aromatic hydrocarbon having polymeric double bond is preferably, for example, styrene; hydrocarbyl (such as alkyl, cycloalkyl, aralkyl, and/or alkenyl having a carbon number from 1 to 30) substitute of styrene (such as α-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinyl benzene, divinyl toluene, divinyl xylene, or trivinyl benzene); vinyl naphthalene; or the like.

(2) Monomer Having Carboxyl Group and Polymeric Double Bond and Salt Thereof

A monomer having a carboxyl group and polymeric double bond is preferably, for example, unsaturated monocarboxylic acid having a carbon number from 3 to 15 [such as (meth) acrylic acid, crotonic acid, isocrotonic acid, or cinnamic acid]; unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid]; monoalkyl(having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester); or the like. "(Meth)acrylic" herein means acrylic and/or methacrylic.

The salt of the monomer above is preferably, for example, alkali metal salt (such as sodium salt or potassium salt), alkaline earth metal salt (such as calcium salt or magnesium salt), ammonium salt, amine salt, or quaternary ammonium salt, or the like.

Amine salt is not particularly limited so long as it is an amine compound. Amine salt is preferably, for example, primary amine salt (such as ethylamine salt, butylamine salt, or octylamine salt); secondary amine salt (such as diethylamine salt or dibutylamine salt); tertiary amine salt (such as triethylamine salt or tributylamine salt); or the like.

Quaternary ammonium salt is preferably, for example, tetraethyl ammonium salt, triethyl lauryl ammonium salt, tetrabutyl ammonium salt, or tributyl lauryl ammonium salt, or the like.

Salt of the monomer having a carboxyl group and polymeric double bond is preferably, for example, sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, or aluminum acrylate, or the like.

(3) Monomer Having Sulfo Group and Polymeric Double Bond and Salt Thereof

A monomer having a sulfo group and polymeric double bond is preferably, for example, vinyl sulfonic acid, α-methylstyrene sulfonic acid, sulfopropyl(meth)acrylate, or 2-(meth)acryloylamino-2,2-dimethylethane sulfonic acid. Salt of a monomer having a sulfo group and polymeric double bond is preferably, for example, salts listed as the "salt of the monomer above" in "(2) Monomer Having Carboxyl Group and Polymeric Double Bond" above.

(4) Monomer Having Phosphono Group and Polymeric Double Bond and Salt Thereof

A monomer having a phosphono group and polymeric double bond is preferably, for example, 2-hydroxyethyl (meth)acryloyl phosphate or 2-acryloyloxy ethyl phosphonic acid. Salt of the monomer having a phosphono group and polymeric double bond is preferably, for example, salts listed as the "salt of the monomer above" in "(2) Monomer Having Carboxyl Group and Polymeric Double Bond" above.

(5) Monomer Having Hydroxyl Group and Polymeric Double Bond

A monomer having a hydroxyl group and polymeric double bond is preferably, for example, hydroxystyrene, N-methylol(meth)acrylamide, or hydroxyethyl(meth)acrylate.

(6) Nitrogen-Containing Monomer Having Polymeric Double Bond

A nitrogen-containing monomer having polymeric double bond is preferably, for example, a monomer shown in (6-1) to (6-4) below.

(6-1) Monomer Having Amino Group and Polymeric Double Bond

A monomer having an amino group and polymeric double bond is preferably, for example, aminoethyl(meth)acrylate, dimethylaminoethyl(meth)acrylate, diethylaminoethyl (meth)acrylate, t-butylaminoethyl(meth)acrylate, N-aminoethyl(meth)acrylamide, (meth)allyl amine, morpholinoethyl (meth)acrylate, 4-vinylpyridine, 2-vinylpyridine, crotyl amine, N,N-dimethylamino styrene, methyl-α-acetamino acrylate, vinylimidazole, N-vinylpyrrole, N-vinyl thiopyrrolidone, N-aryl phenylenediamine, aminocarbazole, aminothiazole, aminoindole, aminopyrrole, aminoimidazole, aminomercaptothiazole, or the like. The monomer having an amino group and polymeric double bond may be the salts of the monomer listed above. The salts of the monomer listed above are exemplified, for example, by salts listed as the "salt of the monomer above" in "(2) Monomer Having Carboxyl Group and Polymeric Double Bond and Salt Thereof" above.

(6-2) Monomer Having Amide Group and Polymeric Double Bond

A monomer having an amide group and polymeric double bond is preferably, for example, (meth)acrylamide, N-methyl (meth)acrylamide, N-butyl(meth)acrylamide, diacetone acrylamide, N-methylol(meth)acrylamide, N,N'-methyl enebis(meth)acryl amide, cinnamic acid amide, N,N-dimethyl (meth)acryl amide, N,N-dibenzyl(meth)acrylamide, (meth) acrylformamide, N-methyl-N-vinylacetamide, or N-vinylpyrrolidone, or the like.

(6-3) Monomer Having Carbon Number from 3 to 10 and Having Nitrile Group and Polymeric Double Bond A monomer having a carbon number from 3 to 10 and having a nitrile group and polymeric double bond is preferably, for example, (meth)acrylonitrile, cyanostyrene, or cyanoacrylate, or the like.

(6-4) Monomer Having Carbon Number from 8 to 12 and Having Nitro Group and Polymeric Double Bond A monomer having a carbon number from 8 to 12 and having a nitro group and polymeric double bond is preferably, for example, nitrostyrene or the like.

(7) Monomer Having Carbon Number from 6 to 18 and Having Epoxy Group and Polymeric Double Bond A monomer having a carbon number from 6 to 18 and having an epoxy group and polymeric double bond is preferably, for example, glycidyl(meth)acrylate or the like.

(8) Monomer Having Carbon Number from 2 to 16 and Having Halogen Element and Polymeric Double Bond A monomer having a carbon number from 2 to 16 and having a halogen element and polymeric double bond is preferably, for example, vinyl chloride, vinyl bromide, vinylidene chloride, allyl chloride, chlorostyrene, bromostyrene, dichlorostyrene, chloromethylstyrene, tetrafluorostyrene, or chloroprene, or the like.

(9) Ester Having Carbon Number from 4 to 16 and Having Polymeric Double Bond

An ester having a carbon number from 4 to 16 and having polymeric double bond is preferably, for example, vinyl acetate; vinyl propionate; vinyl butyrate; diallyl phthalate; diallyl adipate; isopropenyl acetate; vinyl methacrylate; methyl-4-vinyl benzoate; cyclohexyl methacrylate; benzyl methacrylate; phenyl(meth)acrylate; vinyl methoxy acetate; vinyl benzoate; ethyl-α-ethoxy acrylate; alkyl(meth)acrylate having an alkyl group having a carbon number from 1 to 11 [such as methyl(meth)acrylate, ethyl(meth)acrylate, propyl (meth)acrylate, butyl(meth)acrylate, or 2-ethylhexyl(meth) acrylate]; dialkyl fumarate (two alkyl groups being straight-chain alkyl groups, branched alkyl groups, or alicyclic alkyl groups, having a carbon number from 2 to 8); dialkyl maleate (two alkyl groups being straight-chain alkyl groups, branched alkyl groups, or alicyclic alkyl groups, having a carbon number from 2 to 8); poly(meth)allyloxy alkanes (such as diallyloxyethane, triallyloxyethane, tetraallyloxyethane, tetraallyloxypropane, tetraallyloxybutane, or tetramethallyloxyethane); a monomer having a polyalkylene glycol chain and polymeric double bond [such as polyethylene glycol (Mn=300) mono(meth)acrylate, polypropylene glycol (Mn=500) mono(meth)acrylate, a 10-mole adduct (meth)acrylate of ethylene oxide (hereinafter "ethylene oxide" being abbreviated as "EO") to methyl alcohol, or a 30-mole adduct (meth)acrylate of EO to lauryl alcohol]; poly (meth)acrylates {such as poly(meth)acrylate of polyhydric alcohols [such as ethylene glycol di(meth)acrylate, propylene glycol di(meth)acrylate, neopentyl glycol di(meth)acrylate, trimethylol propane tri(meth)acrylate, or polyethylene glycol di(meth)acrylate]}; or the like. "(Meth)allylo" herein means allylo and/or methallylo.

A vinyl resin is preferably, for example, a styrene-(meth) acrylic acid ester copolymer, a styrene-butadiene copolymer, a (meth)acrylic acid-(meth)acrylic acid ester copolymer, a styrene-acrylonitrile copolymer, a styrene-maleic acid (maleic anhydride) copolymer, a styrene-(meth)acrylic acid copolymer, a styrene-(meth)acrylic acid-divinylbenzene copolymer, a styrene-styrene sulfonic acid-(meth)acrylic acid ester copolymer, or the like.

The vinyl resin may be a homopolymer or a copolymer of a monomer having polymeric double bond in (1) to (9) above, or it may be a polymerized product of a monomer having polymeric double bond in (1) to (9) above and a monomer (m) having a molecular chain (k) and having polymeric double bond. The molecular chain (k) is preferably, for example, a straight-chain hydrocarbon chain having a carbon number from 12 to 27, a branched hydrocarbon chain having a carbon number from 12 to 27, a fluoro-alkyl chain having a carbon number from 4 to 20, a polydimethylsiloxane chain, or the like. A difference in SP value between the molecular chain (k) in the monomer (m) and the insulating liquid is preferably 2 or smaller. The "SP value" herein is a numeric value calculated with a Fedors' method [Polym. Eng. Sci. 14(2) 152, (1974)].

Though the monomer (m) having the molecular chain (k) and polymeric double bond is preferably, for example, monomers (m1) to (m3) below. Two or more of the monomers (m1) to (m3) may be used together as the monomer (m).

The monomer (m1) having straight-chain hydrocarbon chain having carbon number from 12 to 27 (preferably from 16 to 25) and polymeric double bond is preferably, for example, mono-straight-chain alkyl (a carbon number of alkyl being from 12 to 27) ester of unsaturated monocarboxylic acid, mono-straight-chain alkyl (a carbon number of alkyl being from 12 to 27) ester of unsaturated dicarboxylic acid, or the like. Unsaturated monocarboxylic acid and unsaturated dicarboxylic acid above are, for example, a carboxyl group containing vinyl monomer having a carbon number from 3 to 24 such as (meth)acrylic acid, maleic acid, fumaric acid, crotonic acid, itaconic acid, or citraconic acid. A specific example of the monomer (m1) is, for example, dodecyl(meth) acrylate, stearyl(meth)acrylate, behenyl(meth)acrylate, hexadecyl(meth)acrylate, heptadecyl(meth)acrylate, eicosyl (meth)acrylate, or the like.

The monomer (m2) having branched hydrocarbon chain having carbon number from 12 to 27 (preferably from 16 to 25) and polymeric double bond is preferably, for example, branched alkyl (a carbon number of alkyl being from 12 to 27) ester of unsaturated monocarboxylic acid, mono-branched alkyl (a carbon number of alkyl being from 12 to 27) ester of unsaturated dicarboxylic acid, or the like. Unsaturated monocarboxylic acid and unsaturated dicarboxylic acid are exemplified, for example, by those the same as listed as specific examples of unsaturated monocarboxylic acid and unsaturated dicarboxylic acid with regard to the monomer (m1). A specific example of the monomer (m2) is exemplified by 2-decyltetradecyl(meth)acrylate or the like.

The monomer (m3) preferably has a fluoro-alkyl chain having carbon number from 4 to 20 and polymeric double bond.

The second resin has a melting point preferably from 0 to 220° C., more preferably from 30 to 200° C., and further preferably from 40 to 80° C. From a point of view of particle size distribution and a shape of toner particles, as well as powder fluidity, heat-resistant storage stability, and resistance to stress of the liquid developer, the second resin has a melting point preferably not lower than a temperature during manufacturing of the liquid developer. If a melting point of the second resin is lower than a temperature during manufacturing of the liquid developer, it may be difficult to prevent toner particles from uniting with each other and it may be difficult to prevent the toner particles from breaking. In addition, it may be difficult to achieve a narrow width of distribution in particle size distribution of the toner particles. In other words, variation in particle size of toner particles may be great. The "melting point" can be measured with a differential scanning calorimeter (trade name "DSC20" or trade name "SSC/580" manufactured by Seiko Instruments, Inc.) in compliance with a method defined under ASTM D3418-82.

Mn of the second resin (obtained through measurement with GPC) is preferably from 100 to 5000000, more preferably from 200 to 5000000, and further preferably from 500 to 500000. The second resin has an SP value preferably from 7 to 18 $(cal/cm^3)^{1/2}$ and more preferably from 8 to 14 $(cal/cm^3)^{1/2}$.

<Coloring Agent>

A coloring agent has a particle size preferably not larger than 0.3 μm. When a coloring agent has a particle size exceeding 0.3 μm, dispersibility of the coloring agent may become poor, which may result in lowering in degree of gloss. Consequently, a desired color cannot be realized in some cases.

Though a known pigment can be employed as a coloring agent without being particularly limited, from a point of view of cost, light resistance, coloring capability, and the like, pigments below are preferably employed. In terms of color construction, these pigments are normally categorized into a black pigment, a yellow pigment, a magenta pigment, or a cyan pigment, and colors (color images) other than black are basically toned by subtractive color mixture of a yellow pigment, a magenta pigment, or a cyan pigment. A pigment shown below may be used alone, or two or more types of pigments shown below may be used together as necessary.

A pigment contained in a black coloring agent (a black pigment) may be, for example, carbon black such as furnace black, channel black, acetylene black, thermal black, or lamp black, carbon black derived from biomass, or magnetic powders of magnetite or ferrite. Nigrosine (an azine-based compound) which is a purple-black dye may be used alone or in combination. As nigrosine, C. I. Solvent Black 7 or C. I. Solvent Black 5 can be employed.

A pigment contained in a magenta coloring agent (a magenta pigment) is preferably, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, or C. I. Pigment Red 222.

A pigment contained in a yellow coloring agent (a yellow pigment) is preferably, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, or C. I. Pigment Yellow 185.

A pigment contained in a cyan coloring agent (a cyan pigment) is preferably, for example, C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Blue 62, C. I. Pigment Blue 66, or C. I. Pigment Green 7.

<Dispersant for Pigment>

A dispersant for pigment is exemplified as one example of an additive to toner particles. A dispersant for pigment has a function to uniformly disperse a coloring agent (a pigment) in toner particles and it is preferably a basic dispersant. The basic dispersant refers to a dispersant defined below. Namely, 0.5 g of a dispersant for pigment and 20 ml of distilled water are introduced in a screw bottle made of glass, the screw bottle is shaken for 30 minutes with the use of a paint shaker, and the resultant product is filtered. pH of a filtrate obtained through filtration is measured with a pH meter (trade name: "D-51" manufactured by Horiba, Ltd.), and a filtrate of which pH is higher than 7 is defined as a basic dispersant. It is noted that a filtrate of which pH is lower than 7 is referred to as an acid dispersant.

A type of such a basic dispersant is not particularly limited. For example, a basic dispersant is preferably a compound (dispersant) having a functional group such as an amine group, an amino group, an amide group, a pyrrolidone group, an imine group, an imino group, a urethane group, a quaternary ammonium group, an ammonium group, a pyridino group, a pyridium group, an imidazolino group, or an imidazolium group in a molecule. It is noted that what is called a surfactant having a hydrophilic portion and a hydrophobic portion in a molecule normally falls under the dispersant, however, various compounds can be employed, so long as they have a function to disperse a coloring agent (a pigment) as described above.

A commercially available product of such a basic dispersant may be, for example, "Ajisper PB-821" (trade name), "Ajisper PB-822" (trade name), or "Ajisper PB-881" (trade name), manufactured by Ajinomoto Fine-Techno Co., Inc., or "Solsperse 28000" (trade name), "Solsperse 32000" (trade name), "Solsperse 32500" (trade name), "Solsperse 35100" (trade name), or "Solsperse 37500" (trade name), manufactured by Japan Lubrizol Limited. Since a dispersant for pigment is more preferably not dissolved in an insulating liquid, for example, "Ajisper PB-821" (trade name), "Ajisper PB-822" (trade name), or "Ajisper PB-881" (trade name), manufactured by Ajinomoto Fine-Techno Co., Inc. is more preferred. By using such a dispersant for pigment, it becomes easier to obtain toner particles having a desired shape, although a reason is not known.

Preferably 1 to 100 mass % and more preferably 1 to 40 mass % of such a dispersant for pigment is added to the coloring agent (pigment). When an amount of addition of the dispersant for pigment is lower than 1 mass %, dispersibility of the coloring agent (pigment) may be insufficient, and hence necessary ID (image density) cannot be achieved in some cases and fixation strength of toner particles may be lowered. When an amount of addition of the dispersant for pigment exceeds 100 mass %, the dispersant for pigment in an amount more than necessary for dispersing the pigment is added. Therefore, the excessive dispersant for pigment may be dissolved in the insulating liquid, which adversely affects chargeability or fixation strength of toner particles. One type alone of such a dispersant for pigment may be used or two or more types may be mixed for use.

<Shape of Toner Particles>

A median diameter D50 found through measurement of particle size distribution of toner particles based on volume (hereinafter denoted as "median diameter D50 of toner particles") is preferably not smaller than 0.5 μm and not greater than 5.0 μm. This particle size is smaller than a particle size of toner particles contained in a dry developer which has conventionally been used and represents one of the features of the present invention. If median diameter D50 of toner particles is smaller than 0.5 μm, toner particles have too small a particle size and hence mobility of toner particles in electric field may become poor, which may hence lead to lowering in development performance. If median diameter D50 of toner particles exceeds 5.0 uniformity in particle size of toner particles may be lowered, which may hence lead to lowering in image quality. More preferably, toner particles have median diameter D50 not smaller than 0.5 μm and not greater than 2.0 μm.

Median diameter D50 of toner particles can be measured, for example, with a flow particle image analyzer (FPIA-3000S manufactured by Sysmex Corporation). This analyzer can use a solvent as it is as a dispersion medium. Therefore, this analyzer can measure a state of toner particles in a state closer to an actually dispersed state, as compared with a system in which measurement is conducted in a water system.

<Core/Shell Structure>

Toner particles in the present embodiment preferably have a core/shell structure. The "core/shell structure" is such a structure as having the first resin as a core and the second resin as a shell. The core/shell structure includes not only such a structure that the second resin covers at least a part of surfaces of first particles (the first particles containing the first resin) but also such a structure that the second resin adheres to at least a part of surfaces of the first particles. When the toner particles have the core/shell structure, median diameter D50 of toner particles and circularity of toner particles are readily controlled. In the core/shell structure, a mass ratio between a shell resin (the second resin) and a core resin (the first resin) is preferably from 1:99 to 80:20, more preferably from 2:98 to 50:50, and further preferably from 3:97 to 35:65. When a content of the second resin in the resin contained in the toner particles is lower than 1 mass %, formation of particles having the core/shell structure may become difficult. When a content of the second resin in the resin contained in the toner particles exceeds 80 mass %, fixability may lower.

In the core/shell structure, a coloring agent may be contained in the core resin or the shell resin, or in both of the core resin and the shell resin. This is also the case with an additive (for example, a dispersant for pigment) to toner particles.

<Insulating Liquid>

The insulating liquid in the present embodiment has a resistance value preferably to such an extent as not distorting an electrostatic latent image (approximately from $10^{11}$ to $10^{16}$ Ω·cm) and preferably it is a solvent having low odor and toxicity. The insulating liquid is generally exemplified by aliphatic hydrocarbon, alicyclic hydrocarbon, aromatic hydrocarbon, halogenated hydrocarbon, or polysiloxane. In particular from a point of view of low odor and toxicity as well as low cost, the insulating liquid is preferably a normal paraffin based solvent or an isoparaffin based solvent, and preferably Moresco White (trade name, manufactured by MORESCO Corporation), Isopar (trade name, manufactured by Exxon Mobil Corporation), Shellsol (trade name, manufactured by Shell Chemicals Japan Ltd.), or IP Solvent 1620, IP Solvent 2028, or IP Solvent 2835 (each of which is trade name and manufactured by Idemitsu Kosan Co., Ltd.).

<Manufacturing of Liquid Developer>

The liquid developer according to the present embodiment is preferably manufactured by dispersing toner particles in an insulating liquid. Toner particles are preferably manufactured in accordance with a method shown below.

<Method of Manufacturing Toner Particles>

Toner particles are preferably manufactured based on such a known technique as a crushing method or a granulation method. In the crushing method, resin particles and a pigment are mixed and kneaded, and then the mixture is crushed. Crushing is preferably carried out in a dry state or a wet state such as in oil.

The granulation method is exemplified, for example, by a suspension polymerization method, an emulsion polymerization method, a fine particle aggregation method, a method of adding a poor solvent to a resin solution for precipitation, a spray drying method, or a method of forming a core/shell structure with two different types of resins.

In order to obtain toner particles having a small diameter and sharp particle size distribution, the granulation method rather than the crushing method is preferably employed. A resin high in meltability or a resin high in crystallinity is soft even at a room temperature and less likely to be crushed. Therefore, with the granulation method, a desired toner particle size is obtained more easily than with the crushing method. Among the granulation methods, toner particles are preferably manufactured with a method shown below. Initially, a core resin solution is obtained by dissolving a resin in a good solvent. Then, the core resin solution described above is mixed, together with an interfacial tension adjuster, in a poor solvent different in SP value from the good solvent, shear is provided, and thus a droplet is formed. Thereafter, by volatilizing the good solvent, core resin particles are obtained. With this method, controllability of a particle size or a shape of toner particles based on variation in how to provide shear, difference in interfacial tension, or an interfacial tension adjuster (a material for the shell resin) is high. Therefore, toner particles having desired particle size distribution are likely to be obtained.

<Image Formation Apparatus>

A construction of an apparatus for forming an image (image formation apparatus) which is formed by a liquid developer according to the present embodiment is not particularly limited. An image formation apparatus is preferably, for example, a monochrome image formation apparatus in which a monochrome liquid developer is primarily transferred from a photoconductor to an intermediate transfer element and thereafter secondarily transferred to a recording medium (see FIG. 3), an image formation apparatus in which a monochrome liquid developer is directly transferred from a photoconductor to a recording medium, or a multi-color image formation apparatus forming a color image by layering a plurality of types of liquid developers.

EXAMPLES

Though the present invention will be described hereinafter in further detail with reference to Examples, the present invention is not limited thereto.

Manufacturing Example 1

[Manufacturing of Dispersion Liquid (W1) of Shell Particles]

In a beaker made of glass, 100 parts by mass of 2-decyltetradecyl(meth)acrylate, 30 parts by mass of methacrylic acid, 70 parts by mass of an equimolar reactant with hydroxyethyl methacrylate and phenyl isocyanate, and 0.5 part by mass of azobis methoxy dimethyl valeronitrile were introduced, and stirred and mixed at 20° C. Thus, a monomer solution was obtained.

Then, a reaction vessel provided with a stirrer, a heating and cooling apparatus, a thermometer, a dropping funnel, a desolventizer, and a nitrogen introduction pipe was prepared. In that reaction vessel, 195 parts by mass of THF were introduced, and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was added to the reaction vessel and caused to react for 3 hours at 70° C. Thereafter, cooling to room temperature was carried out. Thus, a copolymer solution was obtained.

The shell resin in a dry state was obtained by removing THF from some of the obtained copolymer solution. A glass transition temperature of the shell resin in the dry state was measured with a differential scanning calorimeter (trade name "DSC20" manufactured by Seiko Instruments, Inc.) in compliance with a method defined under ASTM D3418-82, and it was 53° C.

Four hundred parts by mass of the obtained copolymer solution were dropped in 600 parts by mass of IP Solvent 2028 (manufactured by Idemitsu Kosan Co., Ltd.) which was being stirred, and THF was distilled out at 40° C. at a reduced pressure of 0.039 MPa. Thus, a dispersion liquid (W1) of shell particles was obtained. A volume average particle size of the shell particles in the dispersion liquid (W1) was measured with a laser particle size distribution analyzer (trade name "LA-920" manufactured by Horiba, Ltd.), which was 0.12 μm.

Manufacturing Example 2

[Manufacturing of Solution (Y1) for Forming Core Resin]

In a reaction vessel provided with a stirrer, a heating and cooling apparatus, and a thermometer, 970 parts by mass of polyester resin (Mn: 5400) obtained from sebacic acid, adipic acid, and ethylene glycol (a molar ratio of 0.8:0.2:1) and 300 parts by mass of acetone were introduced and stirred for uniform solution in acetone. In the obtained solution, 30 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 23000 and a concentration of a urethane group therein was 1.6%.

One thousand parts by mass of the obtained core resin and 1000 parts by mass of acetone were stirred in a beaker, to thereby uniformly dissolve the core resin in acetone. Thus, a solution (Y1) for forming the core resin was obtained.

Manufacturing Example 3

[Manufacturing of Solution (Y2) for Forming Core Resin]

In a reaction vessel provided with a stirrer, a heating and cooling apparatus, and a thermometer, 890 parts by mass of polyester resin (Mn: 1400) obtained from sebacic acid, adipic acid, and ethylene glycol (a molar ratio of 0.8:0.2:1) and 300 parts by mass of acetone were introduced and stirred for uniform solution in acetone. In the obtained solution, 105 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 15000 and a concentration of a urethane group therein was 5.5%.

One thousand parts by mass of the obtained core resin and 1000 parts by mass of acetone were stirred in a beaker, to thereby uniformly dissolve the core resin in acetone. Thus, a solution (Y2) for forming the core resin was obtained.

Manufacturing Example 4

[Manufacturing of Solution (Y3) for Forming Core Resin]

In a reaction vessel provided with a stirrer, a heating and cooling apparatus, and a thermometer, 970 parts by mass of polyester resin (Mn: 4760) obtained from sebacic acid, adipic acid, and ethylene glycol (a molar ratio of 0.8:0.2:1) and 300 parts by mass of acetone were introduced and stirred for uniform solution in acetone. In the obtained solution, 30 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 13000 and a concentration of a urethane group therein was 1.5%.

One thousand parts by mass of the obtained core resin and 1000 parts by mass of acetone were stirred in a beaker, to thereby uniformly dissolve the core resin in acetone. Thus, a solution (Y3) for forming the core resin was obtained.

Manufacturing Example 5

[Manufacturing of Solution (Y4) for Forming Core Resin]

In a reaction vessel provided with a stirrer, a heating and cooling apparatus, and a thermometer, 970 parts by mass of polyester resin (Mn: 6500) obtained from sebacic acid, adipic acid, and ethylene glycol (a molar ratio of 0.8:0.2:1) and 300 parts by mass of acetone were introduced and stirred for uniform solution in acetone. In the obtained solution, 28 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 45000 and a concentration of a urethane group therein was 1.5%.

One thousand parts by mass of the obtained core resin and 1000 parts by mass of acetone were stirred in a beaker, to thereby uniformly dissolve the core resin in acetone. Thus, a solution (Y4) for forming the core resin was obtained.

Manufacturing Example 6

[Manufacturing of Solution (Y5) for Forming Core Resin]

In a reaction vessel provided with a stirrer, a heating and cooling apparatus, and a thermometer, 920 parts by mass of polyester resin (Mn: 2200) obtained from sebacic acid, adipic acid, and ethylene glycol (a molar ratio of 0.8:0.2:1) and 300 parts by mass of acetone were introduced and stirred for uniform solution in acetone. In the obtained solution, 85 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 30000 and a concentration of a urethane group therein was 4.5%.

One thousand parts by mass of the obtained core resin and 1000 parts by mass of acetone were stirred in a beaker, to thereby uniformly dissolve the core resin in acetone. Thus, a solution (Y5) for forming the core resin was obtained.

Manufacturing Example 7

[Manufacturing of Solution (Y6) for Forming Core Resin]

In a reaction vessel provided with a stirrer, a heating and cooling apparatus, and a thermometer, 990 parts by mass of polyester resin (Mn: 11500) obtained from sebacic acid, adipic acid, and ethylene glycol (a molar ratio of 0.8:0.2:1) and 300 parts by mass of acetone were introduced and stirred for uniform solution in acetone. In the obtained solution, 10 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 23000 and a concentration of a urethane group therein was 0.5%.

One thousand parts by mass of the obtained core resin and 1000 parts by mass of acetone were stirred in a beaker, to thereby uniformly dissolve the core resin in acetone. Thus, a solution (Y6) for forming the core resin was obtained.

Manufacturing Example 8

[Manufacturing of Solution (Y7) for Forming Core Resin]

In a reaction vessel provided with a stirrer, a heating and cooling apparatus, and a thermometer, 970 parts by mass of polyester resin (Mn: 6660) obtained from sebacic acid, adipic acid, and ethylene glycol (a molar ratio of 0.8:0.2:1) and 300 parts by mass of acetone were introduced and stirred for uniform solution in acetone. In the obtained solution, 30 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 53000 and a concentration of a urethane group therein was 1.5%.

One thousand parts by mass of the obtained core resin and 1000 parts by mass of acetone were stirred in a beaker, to thereby uniformly dissolve the core resin in acetone. Thus, a solution (Y7) for forming the core resin was obtained.

Manufacturing Example 9

[Manufacturing of Solution (Y8) for Forming Core Resin]

In a reaction vessel provided with a stirrer, a heating and cooling apparatus, and a thermometer, 910 parts by mass of polyester resin (Mn: 2000) obtained from sebacic acid, adipic acid, and ethylene glycol (a molar ratio of 0.8:0.2:1) and 300 parts by mass of acetone were introduced and stirred for uniform solution in acetone. In the obtained solution, 90 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 33000 and a concentration of a urethane group therein was 6%.

One thousand parts by mass of the obtained core resin and 1000 parts by mass of acetone were stirred in a beaker, to thereby uniformly dissolve the core resin in acetone. Thus, a solution (Y8) for forming the core resin was obtained.

Manufacturing Example 10

[Manufacturing of Solution (Y9) for Forming Core Resin]

In a reaction vessel provided with a stirrer, a heating and cooling apparatus, and a thermometer, 940 parts by mass of polyester resin (Mn: 2080) obtained from sebacic acid, adipic acid, and ethylene glycol (a molar ratio of 0.8:0.2:1) and 300 parts by mass of acetone were introduced and stirred for uniform solution in acetone. In the obtained solution, 60 parts by mass of IPDI were introduced and caused to react for 6 hours at 80° C. When an NCO value attained to 0, 28 parts by mass of terephthalic acid were further added and caused to react for 1 hour at 180° C. Thus, a core resin which was a urethane-modified polyester resin was obtained. Mn of the obtained core resin was 5000 and a concentration of a urethane group therein was 3%.

One thousand parts by mass of the obtained core resin and 1000 parts by mass of acetone were stirred in a beaker, to thereby uniformly dissolve the core resin in acetone. Thus, a solution (Y9) for forming the core resin was obtained.

Manufacturing Example 11

[Manufacturing of Solution (Y10) for Forming Core Resin]

In a reaction vessel provided with a stirrer, a heating and cooling apparatus, and a thermometer, a polyester resin (number average molecular weight: 2500) obtained from terephthalic acid and an adduct of propylene oxide to bisphenol A (a molar ratio of 1:1) was obtained.

One thousand parts by mass of the obtained core resin and 1000 parts by mass of acetone were stirred in a beaker, to thereby uniformly dissolve a core resin in acetone. Thus, a solution (Y10) for forming the core resin was obtained.

Manufacturing Example 12

[Manufacturing of Dispersion Liquid (P1) of Pigment]

In a beaker, 20 parts by mass of acid-treated copper phthalocyanine (trade name "FASTGEN Blue FDB-14" manufactured by DIC Corporation), 5 parts by mass of a dispersant for pigment "Ajisper PB-821" (trade name, manufactured by Ajinomoto Fine-Techno Co., Inc.), and 75 parts by mass of acetone were introduced and stirred, for uniform dispersion of copper phthalocyanine. Thereafter, copper phthalocyanine was finely dispersed with the use of a bead mill. Thus, a dispersion liquid (P1) of a pigment was obtained. A laser particle size distribution analyzer (trade name "LA-920" manufactured by Horiba, Ltd.) was used to measure a volume average particle size of the pigment (copper phthalocyanine) in the dispersion liquid (P1) of the pigment, which was 0.2 μm.

Example 1

Forty parts by mass of the solution (Y1) for forming the core resin and 20 parts by mass of the dispersion liquid of the pigment (P1) were stirred in a beaker at 8000 rpm with the use of TK Auto Homo Mixer [manufactured by PRIMIX Corporation] at 25° C. Thus, a resin solution (Y11) in which the pigment was uniformly dispersed was obtained.

In another beaker, 67 parts by mass of IP Solvent 2028 (manufactured by Idemitsu Kosan Co., Ltd.) and 13 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y11) were introduced and stirred for 2 minutes. This liquid mixture was then introduced in a reaction vessel provided with a stirrer, a heating and cooling apparatus, a thermometer, and a desolventizer, and a temperature was raised to 35° C. At a reduced pressure of 0.039 MPa at 35° C., acetone was distilled out until a concentration of acetone was not higher than 0.5 mass %. Thus, a liquid developer was obtained. The coloring agent was contained by 20 mass % with respect to the toner particles.

Examples 2 to 5 and Comparative Examples 1 to 5

Liquid developers in Examples 2 to 5 and Comparative Examples 1 to 5 were manufactured in accordance with the method described in Example 1 above, except that the solutions for forming the core resin shown in Table 1 were employed instead of the solution (Y1) for forming the core resin.

<Fixation Process>

Figure 3:
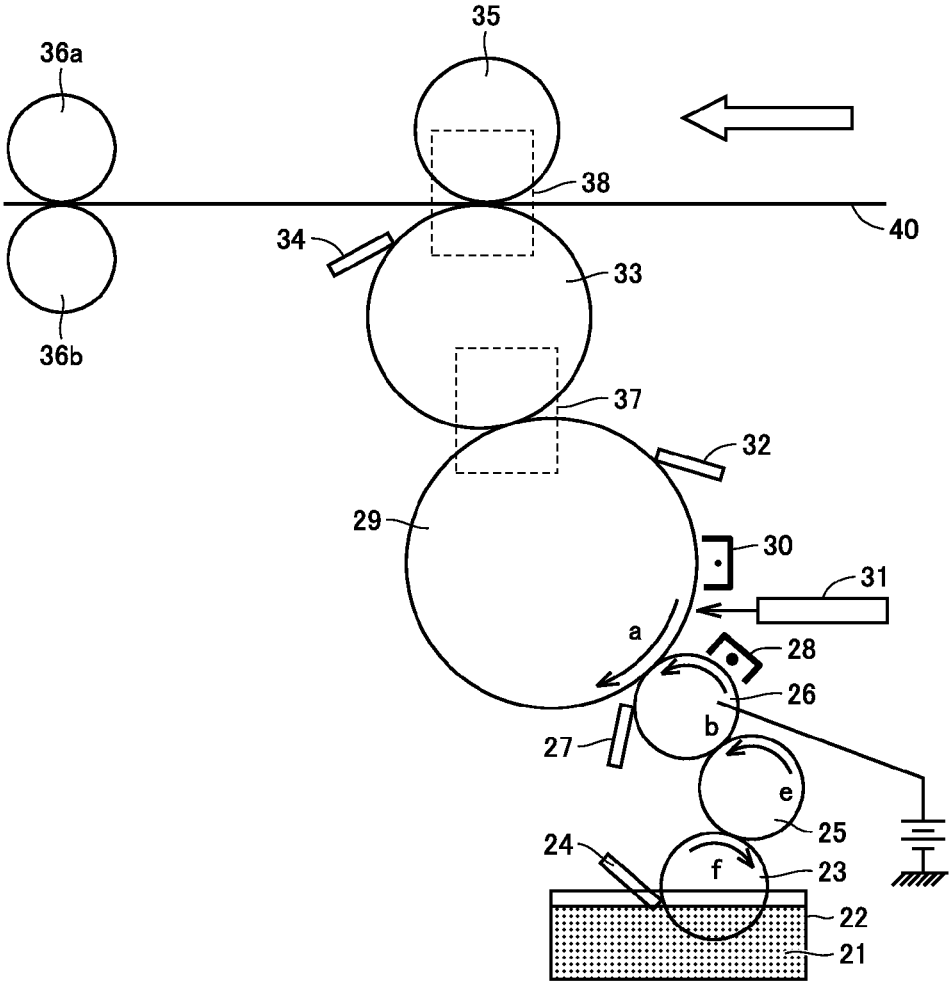
FIG. 3 is a schematic conceptual diagram of an image formation apparatus of an electrophotography type.

An image was formed by using an image formation apparatus shown in FIG. 3. A construction of the image formation apparatus shown in FIG. 3 is shown below. A liquid developer 21 is brought up from a development tank 22 by an anilox roller 23. Excessive liquid developer 21 on anilox roller 23 is scraped off by an anilox restriction blade 24, and remaining liquid developer 21 is sent to a leveling roller 25. Liquid developer 21 is adjusted to be uniform and small in thickness, on leveling roller 25.

Liquid developer 21 on leveling roller 25 is sent to a development roller 26. Liquid developer 21 on development roller 26 is charged by a development charger 28 and developed on a photoconductor 29 and the excessive liquid developer is scraped off by a development cleaning blade 27. Specifically, a surface of photoconductor 29 is evenly charged by a charging portion 30, and an exposure portion 31 arranged around photoconductor 29 emits light based on prescribed image information to the surface of photoconductor 29. Thus, an electrostatic latent image based on the prescribed image information is formed on the surface of photoconductor 29. As the formed electrostatic latent image is developed, a toner image is formed on photoconductor 29. The excessive liquid developer on photoconductor 29 is scraped off by a cleaning blade 32.

The toner image formed on photoconductor 29 is primarily transferred to an intermediate transfer element 33 at a primary transfer portion 37, and the liquid developer transferred to intermediate transfer element 33 is secondarily transferred to a recording medium 40 at a secondary transfer portion 38. The liquid developer transferred to recording medium 40 is fixed by fixation rollers 36*a* and 36*b*. The liquid developer which remained on intermediate transfer element 33 without being secondarily transferred is scraped off by an intermediate transfer element cleaning portion 34.

In the present Example, the surface of photoconductor 29 was positively charged by charging portion 30, a potential of intermediate transfer element 33 was set to −400 V, a potential of a secondary transfer roller 35 was set to −1200 V, a fixation NIP time was set to 40 milliseconds, and a temperature of fixation rollers 36*a* and 36*b* was set to 80° C. OK top coat (manufactured by Oji Paper Co., Ltd., 127 g/m$^2$) was employed as recording medium 40, a velocity of transportation of recording medium 40 was set to 400 mm/s, an amount of adhesion of toner on the recording medium was approximately 2.0 g/m$^2$ or less.

<Measurement of Peak Temperature in DSC Curve in Temperature Increase and Peak Temperature in DSC Curve in Temperature Decrease>

The DSC curve was measured in accordance with the method above, and a peak temperature in the DSC curve in temperature increase of the toner particles and a peak temperature in the DSC curve in temperature decrease of the toner particles were found from the obtained DSC curve. A peak temperature in the DSC curve in temperature increase of the toner particles is shown with T1 (° C.) in Table 1, and a peak temperature in the DSC curve in temperature decrease of the toner particles is shown with T2 (° C.) in Table 1.

<Measurement of Storage Elastic Modulus at 80° C. (G'(80))>

Temperature dependency of storage elastic modulus G' was determined in accordance with the method above, and G'(80) was found. Table 1 shows results.

<Evaluation of Document Offset>

While fixed images were layered on each other, load of 80 g/cm$^2$ was applied thereto and stored for 10 days at 55° C. Thereafter, after the temperature was lowered to room temperature and the load was removed, two sheets were separated from each other and whether or not the images were damaged at the time of separation was checked. Results are shown in Table 1. In Table 1, a case that the images were not at all separated at the time of separation is denoted as A1 and a case that the images were separated at the time of separation is denoted as B1. It can be concluded that no document offset took place if the images were not separated at the time of separation.

<Measurement of Degree of Gloss>

Seventy-five-degree Gloss Meter (VG-2000 manufactured by Nippon Denshoku Industries Co., Ltd.) was used to measure a degree of gloss of a solid portion of a fixed image. Results are shown in Table 1. In Table 1, a degree of gloss not lower than 50 is denoted as A2, and a degree of gloss lower than 50 is denoted as B2. As a degree of gloss is higher, it can be concluded that such a liquid developer is excellent in glossiness.

<Evaluation of High-Temperature Offset>

Immediately after coated paper was passed, white paper was passed to observe whether or not high-temperature offset occurred. Results are shown in Table 1. In Table 1, a case that white paper was not contaminated with toner is denoted as A3 and a case that white paper was contaminated with toner is denoted as B3. When high-temperature offset occurs, fixation rollers 36*a* and 36*b* are contaminated and the contamination is transferred to white paper. Therefore, when white paper was not contaminated with toner, it can be concluded that no high-temperature offset occurred.

TABLE 1

| | Solution for Forming Core Resin | T1 (° C.) | T2 (° C.) | G'(80) (Pa) | x | y (%) | Document Offset | Degree of Gloss | High-Temperature Offset |
|---|---|---|---|---|---|---|---|---|---|
| Example 1 | Y1 | 57 | 37 | $1 \times 10^6$ | 23000 | 1.6 | A1 | A2 | A3 |
| Example 2 | Y2 | 55 | 30 | $3.2 \times 10^5$ | 15000 | 5.5 | A1 | A2 | A3 |
| Example 3 | Y3 | 62 | 38 | $1 \times 10^5$ | 13000 | 1.5 | A1 | A2 | A3 |
| Example 4 | Y4 | 63 | 42 | $1 \times 10^7$ | 45000 | 1.5 | A1 | A2 | A3 |
| Example 5 | Y5 | 61 | 32 | $3.2 \times 10^6$ | 30000 | 4.5 | A1 | A2 | A3 |
| Comparative Example 1 | Y6 | 59 | 44 | $3.2 \times 10^4$ | 23000 | 0.5 | A1 | A2 | B3 |
| Comparative Example 2 | Y7 | 45 | 37 | $3.2 \times 10^7$ | 53000 | 1.5 | B1 | B2 | A3 |
| Comparative Example 3 | Y8 | 47 | 28 | $3.2 \times 10^6$ | 33000 | 6 | B1 | B2 | A3 |
| Comparative Example 4 | Y9 | 60 | 33 | $1 \times 10^4$ | 5000 | 3 | A1 | A2 | B3 |
| Comparative Example 5 | Y10 | — | — | $1 \times 10^6$ | 2500 | 0 | A1 | B2 | A3 |

Figure 4:
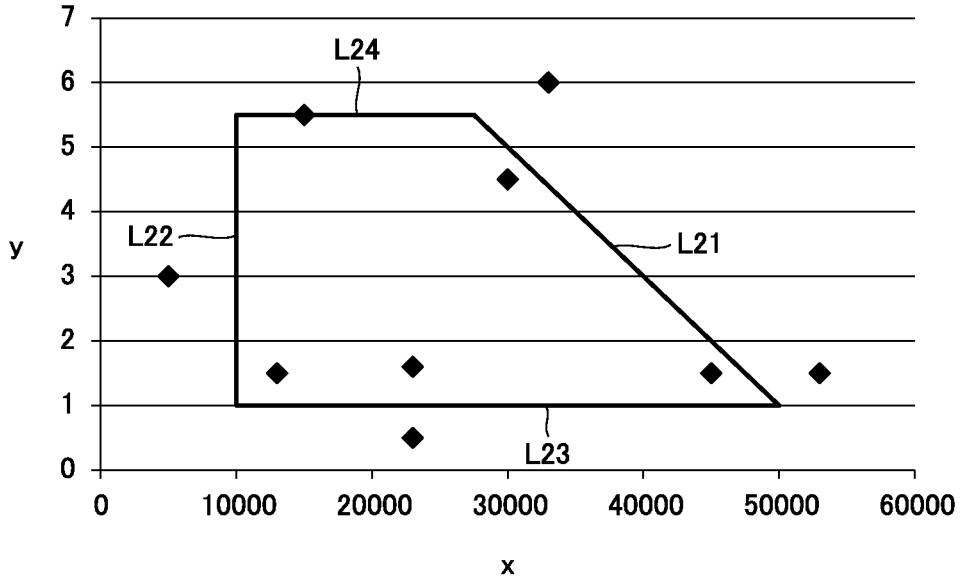
FIG. 4 is a graph showing results in Examples.

As shown in Table 1, in Examples 1 to 5, occurrence of high-temperature offset and document offset could be prevented while moderate gloss was ensured. The reason may be because peak temperature T1 in the DSC curve in temperature increase of the toner particles was not lower than 55° C., peak temperature T2 in the DSC curve in temperature decrease of the toner particles was not lower than 30° C., and the toner particles had a storage elastic modulus at 80° C. G'(80), not lower than $1\times10^5$ Pa and not higher than $1\times10^7$ Pa. Specifically, the results in Examples 1 to 5 are present in a region surrounded by L21 to L24 shown in FIG. 4. FIG. 4 is a graph showing relation (experimental results) between a number average molecular weight x of the urethane-modified polyester resin and a concentration of a urethane group y in the urethane-modified polyester resin. A result in Comparative Example 5 is not illustrated in FIG. 4.

In Comparative Example 1, high-temperature offset occurred. The reason may be because the toner particles had storage elastic modulus at 80° C. G'(80), lower than $1\times10^5$ Pa, and specifically, a concentration a urethane group y in the urethane-modified polyester resin was lower than 1%. As shown in FIG. 4, the result in Comparative Example 1 is present under L23.

In Comparative Example 2, document offset occurred. The reason may be because peak temperature T1 in the DSC curve in temperature increase of the toner particles was lower than 55° C., and specifically, relation of $y \leq -0.0002x+11$ was not satisfied. As shown in FIG. 4, the result in Comparative Example 2 is present on the right of L21.

In Comparative Example 2, a degree of gloss also lowered. The reason may be because the toner particles had storage elastic modulus at 80° C. G'(80) higher than $1\times10^7$ Pa, and specifically, a number average molecular weight x of the urethane-modified polyester resin exceeded 50000.

In Comparative Example 3, document offset occurred. The reason may be because peak temperature T1 in the DSC curve in temperature increase of the toner particles was lower than 55° C. and peak temperature T2 in the DSC curve in temperature decrease of the toner particles was lower than 30° C. Specifically, relation of $y \leq -0.0002x+11$ was not satisfied and a concentration a urethane group y in the urethane-modified polyester resin exceeded 5.5%. As shown in FIG. 4, the result in Comparative Example 3 is present above L21. In Comparative Example 3, a degree of gloss also lowered.

In Comparative Example 4, high-temperature offset occurred. The reason may be because the toner particles had storage elastic modulus at 80° C. G'(80) lower than $1\times10^5$ Pa, and specifically, a number average molecular weight x of the urethane-modified polyester resin was lower than 10000. As shown in FIG. 4, the result in Comparative Example 4 is present on the left of L22.

In Comparative Example 5, a degree of gloss lowered. The reason may be because the toner particles in Comparative Example 5 did not contain a crystalline resin.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer, comprising:

an insulating liquid; and toner particles which are dispersed in said insulating liquid and contain a resin and a coloring agent, said resin containing a first resin which is a crystalline urethane-modified polyester resin resulting from increase in chain length of a component derived from a polyester resin by a compound containing an isocyanate group, said toner particles having a peak in a DSC curve in temperature increase at 55° C. or higher, having a peak in the DSC curve in temperature decrease at 30° C. or higher, and having a storage elastic modulus at 80° C., not lower than $1\times10^5$ Pa and not higher than $1\times10^7$ Pa.

2. The liquid developer according to claim 1, wherein x and y satisfy Equations (1) to (3):

$$y \leq -0.0002x+11 \quad (1);$$

$$10000 \leq x \leq 50000 \quad (2); \text{ and}$$

$$1 \leq y \leq 5.5 \quad (3),$$

where x represents a number average molecular weight of said first resin and y represents a concentration of a urethane group in said first resin.

3. The liquid developer according to claim 1, wherein said toner particles further contain a basic dispersant.

4. The liquid developer according to claim 1, wherein said toner particles have a core/shell structure.

* * * * *